US010972828B2

(12) United States Patent
Luo et al.

(10) Patent No.: US 10,972,828 B2
(45) Date of Patent: Apr. 6, 2021

(54) HEADPHONE WITH A HEADBAND FRICTION MECHANISM

(71) Applicant: GN Audio A/S, Ballerup (DK)

(72) Inventors: Andy Luo, Ballerup (DK); Mads Schenstrøm Stefansen, Ballerup (DK); Libra Su, Ballerup (DK); Silas Zhang, Ballerup (DK)

(73) Assignee: GN AUDIO A/S, Ballerup (DK)

( * ) Notice: Subject to any disclaimer, the term of this patent is extended or adjusted under 35 U.S.C. 154(b) by 0 days.

(21) Appl. No.: 16/717,567

(22) Filed: Dec. 17, 2019

(65) Prior Publication Data

US 2020/0213710 A1 Jul. 2, 2020

(30) Foreign Application Priority Data

Dec. 27, 2018 (CN) ..... 201811614095.0
Jan. 5, 2019 (DK) ..... PA201900012

(51) Int. Cl.
*H04R 1/10* (2006.01)

(52) U.S. Cl.
CPC ..... *H04R 1/1066* (2013.01); *H04R 1/105* (2013.01); *H04R 1/1008* (2013.01)

(58) Field of Classification Search
CPC combination set(s) only.
See application file for complete search history.

(56) References Cited

U.S. PATENT DOCUMENTS 5,033,094 A * 7/1991 Hung ..... H04R 1/1058 381/379
2010/0046782 A1* 2/2010 Ito ..... H04R 1/105 381/378
2017/0201820 A1 7/2017 Inoue
(Continued)

FOREIGN PATENT DOCUMENTS

CN 203872322 10/2014
CN 206164775 5/2017
(Continued)

OTHER PUBLICATIONS

1st technical examination of the Danish priority application No. PA 2019 00012 dated Aug. 16, 2019.
(Continued)

*Primary Examiner* — Thang V Tran
(74) *Attorney, Agent, or Firm* — Hamre, Schumann, Mueller & Larson, P.C.

(57) ABSTRACT

A headphone (1) comprising a first earphone (2) and a headband (3) to be arranged around the head of a user The headband (3) comprises a first headband part (4) and a second headband part (5), which are slidably connected to each other, so that the length of the headband (3) can be adjusted in a longitudinal direction (Y). There is provided a controlled friction mechanism, that controls the friction between the first headband part (4) and the second headband part (5). The friction mechanism comprises a first cantilever (8) comprised by the second headband part (5) and a first friction element (11) of elastomeric abutment material,
(Continued)

which is attached to the first cantilever (8) and which due to elastic deformation of the first cantilever (8) abuts and exerts a force against a first contact area of the first headband part (4).

10 Claims, 2 Drawing Sheets

(56) References Cited

U.S. PATENT DOCUMENTS

| | | | | |
|---|---|---|---|---|
| 2017/0257695 | A1* | 9/2017 | Smiechowski ..... | H04R 1/1066 |
| 2020/0280801 | A1* | 9/2020 | Andersen ..... | H04R 1/1008 |

FOREIGN PATENT DOCUMENTS

| | | |
|---|---|---|
| JP | 2004096792 | 3/2004 |
| JP | 2018088661 A | 6/2018 |

OTHER PUBLICATIONS

The extended European search report issued in European Application No. 19209508.1, dated Feb. 13, 2020, 7 pages provided.

* cited by examiner

HEADPHONE WITH A HEADBAND FRICTION MECHANISM

TECHNICAL FIELD

The invention relates to a headphone comprising a first earphone and a headband to be arranged around the head of a user, wherein the headband comprises a first headband part and a second headband part, which are slidably connected to each other, so that the length of the headband can be adjusted in a longitudinal direction, wherein there is provided a controlled friction mechanism, that controls the friction between the first headband part and the second headband part.

BACKGROUND ART

Headphones with headbands are normally adjustable in way, where the length of the headband can be adjusted in order to adapt the headphone to the size of the user's head. Duo headphones comprise two earphones, which are interconnected by the headband. Monaural headphones comprise just one earphone at one end of the headband and an abutment device at the other end of the headband. The length adjustability of the headband can be carried out in many ways. US 2017/0257695 discloses a headphone according to the preliminary part of claim 1, where a constant friction is obtained by a compressible brake pad. The object of the invention is to provide a new and simple way of providing a new friction mechanism, which can be used with a length adjustability mechanism.

DISCLOSURE OF INVENTION

The headphone according to preamble is characterized in that the friction mechanism comprises a first cantilever comprised by the second headband part and a first friction element of frictional abutment material, which is attached to the first cantilever and which due to elastic deformation of the first cantilever abuts and exerts a force against the first headband part. The frictional abutment material determines the friction coefficient and the cantilever provides the desired pressure force. Thus, the desired force is not based on the compressibility of the friction element, which is worn over time.

According to an embodiment, the friction mechanism comprises a second cantilever comprised by the second headband part and a second friction element of elastomeric abutment material, which is attached to the second cantilever and due to elastic deformation of the second cantilever abuts and exerts a pressure against a second contact area of the first headband part.

According to an embodiment, the first and second friction elements exert pressure in opposite directions.

According to an embodiment, the friction mechanism comprises a third cantilever comprised by the second headband part and a third friction element of elastomeric abutment material, which is attached to the third cantilever and due to elastic deformation of the third cantilever abuts and exerts a pressure against a third contact area of the first headband part.

According to an embodiment, the cantilevers are made of plastics and the elastomeric abutment material is rubber or silicone rubber.

According to an embodiment, the contact areas of the first headband part is made plastics, such as Polybutylene Terephthalate (PBT), Polycarbonate (PC) or Acrylonitrile Butadiene Styrene (ABS).

According to an embodiment, the cantilevers are 7-15 mm long, 2-8 mm wide and 0.2-1 mm thick.

According to an embodiment, the second headband part is slidable received in the first headband part.

According to an embodiment, the sliding movement between the first and second headband parts is guided by ribs and grooves.

According to an embodiment, ribs are provided in inner side walls of the first headband part, and grooves are provided in outer sidewalls of the second headband part.

BRIEF DESCRIPTION OF THE DRAWINGS

The invention is explained in detail below with reference to the drawing illustrating a preferred embodiment of the invention and in which.

MODES FOR CARRYING OUT THE INVENTION

Figure 1:
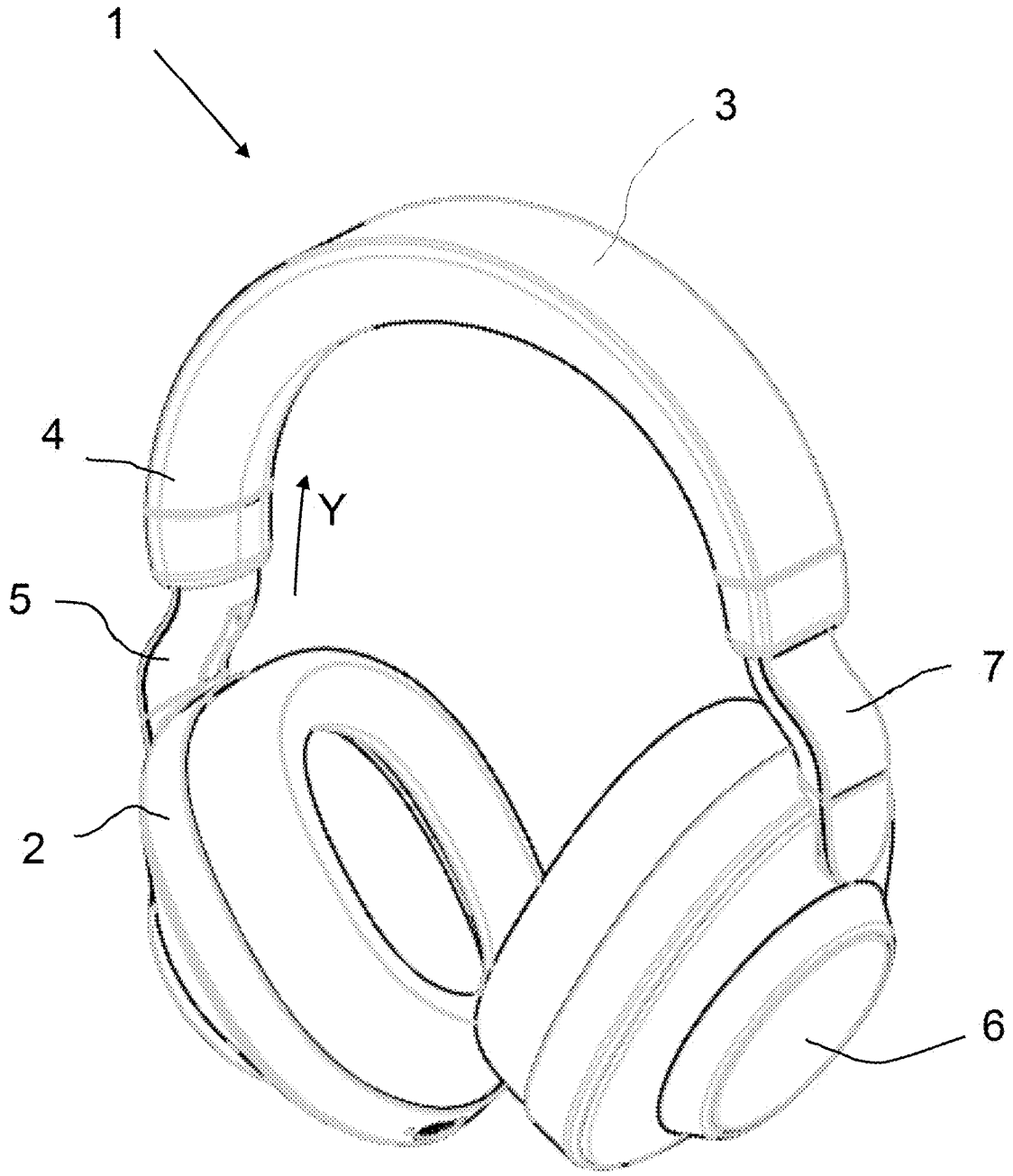
FIG. 1 is a perspective view of a headphone according to the invention.

FIG. 1 is a perspective view of a headset 1 according to the invention. The headphone 1 comprises a headband 3 interconnecting a first earphone 2 and a second earphone 6. The headband 3 comprises a first headband part 4, a second headband part 5 and a third headband part 7. The second and third headband parts 5, 7 are telescopically received in each end of the first headband part 4.

Figure 2:
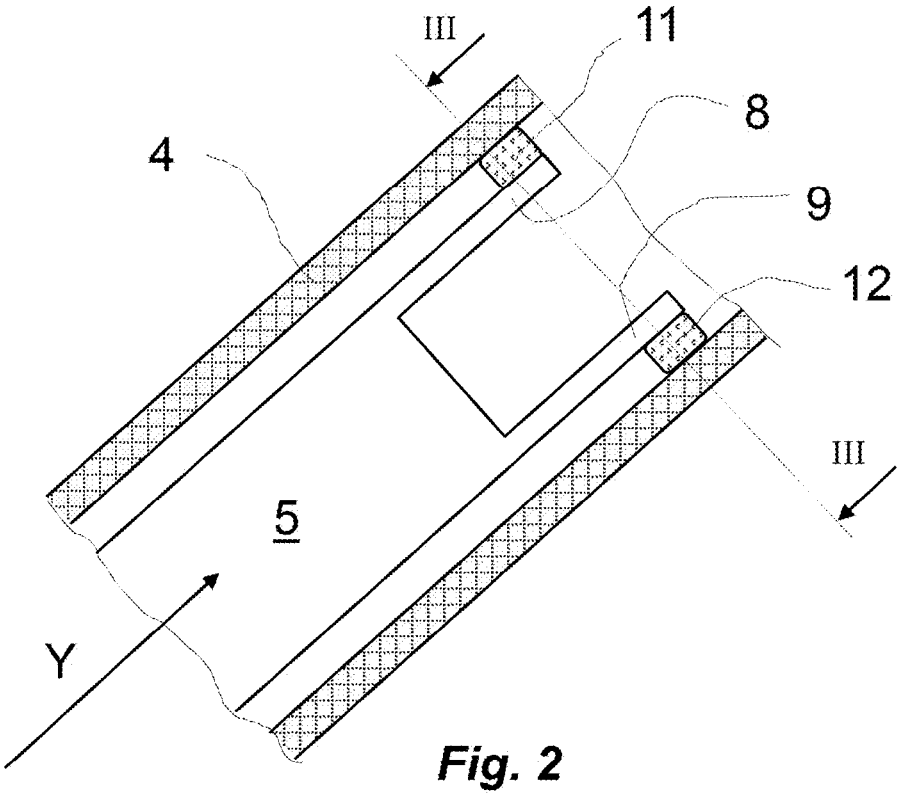
FIG. 2 is a longitudinal sectional view through a friction mechanism of the headphone according to the invention.
Figure 3:
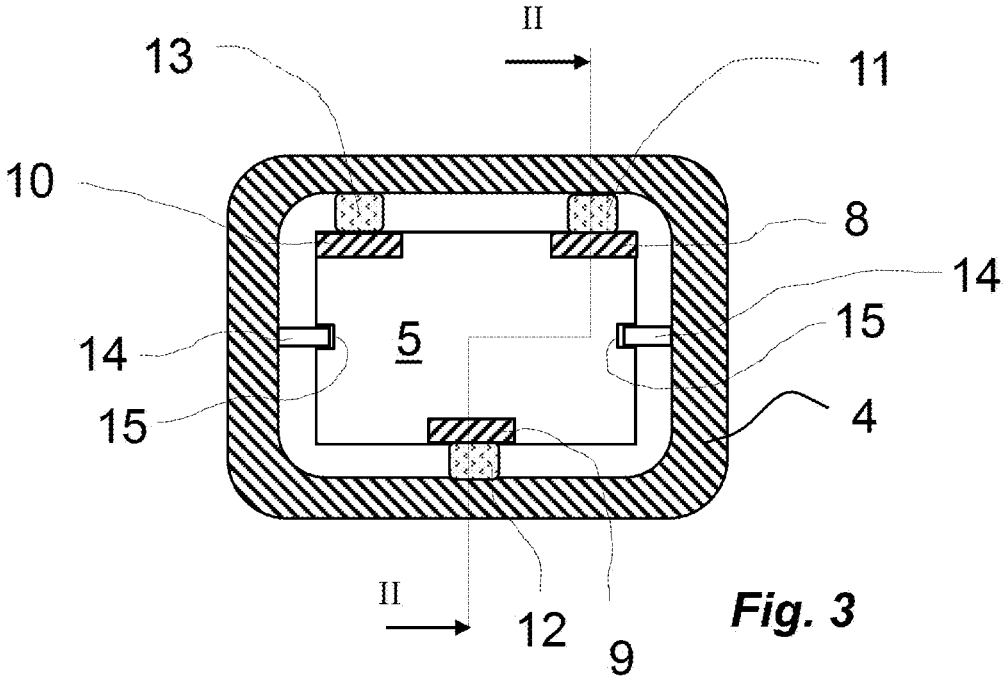
FIG. 3 is cross-sectional view through the friction mechanism.

FIG. 2 is a longitudinal sectional view and FIG. 3 a cross-sectional view through a friction mechanism of the headphone 1. The section shown in FIG. 2 is schematic and shown straight, but it is in real curved. The first headband part 4 is a tubular structure. Inside this structure, the second headband structure 5 can telescopically slide in an against the direction Y. The second headband part 5 is made of molded plastic and comprises three protruding cantilevers, namely first, second and third cantilevers 8, 9, 10. On the side of the cantilevers facing the inner walls of the first headband part 4, friction elements 11, 12, 13 are attached to the cantilevers 8, 9, 10. These friction elements are made of silicone rubber, which typically has a friction coefficient between 0.25 and 0.75 against a hard plastics surface. Hard plastics such as Polybutylene Terephthalate (PBT), Polycarbonate (PC) or Acrylonitrile Butadiene Styrene (ABS) may be used for the first headband part 4. The As seen in FIG. 3 the first friction element 11 and the third friction element 13 abuts an upper inner wall of the first headband part 4. The second friction element 12 abuts a lower inner wall of the first headband part 4. The telescopic movement between the first and second headband parts 4, 5 is guided by ribs 14, which are extending from the vertical internal sidewalls of the first headband part 4, and which are sliding in longitudinal grooves 15 in the vertical outer walls of the second headband part 5. The friction force between the friction elements 11, 12, 13 and the internal sidewalls of the first headband part 4 is a product of the normal force and the friction coefficient. The normal force is primarily provided by the cantilevers 8, 9, 10, which were bended away from the internal sidewalls of the first headband part 4 during assembly.

REFERENCE SIGNS

1 Headset
2 First earphone

3 Headband
4 First headband part
5 Second headband part
6 Second earphone
7 Third headband part
8 First cantilever
9 Second cantilever
10 Third cantilever
11 First friction element
12 Second friction element
13 Third friction element
14 guiding rib
15 groove

The invention claimed is:

1. A headphone comprising a first earphone and a headband to be arranged around the head of a user, wherein the headband comprises a first headband part and a second headband part, which are slidably connected to each other, so that the length of the headband can be adjusted in a longitudinal direction, wherein there is provided a controlled friction mechanism, that controls the friction between the first headband part and the second headband part, wherein the friction mechanism comprises a first cantilever comprised by the second headband part and a first friction element of elastomeric abutment material, which is attached to the first cantilever and which due to elastic deformation of the first cantilever abuts and exerts a force against a first contact area of the first headband part.

2. A headphone according to claim 1, wherein the friction mechanism comprises a second cantilever comprised by the second headband part and a second friction element of elastomeric abutment material, which is attached to the second cantilever and due to elastic deformation of the second cantilever abuts and exerts a pressure against a second contact area of the first headband part.

3. A headphone according to claim 2, wherein the first and second friction elements exert pressure in opposite directions.

4. A headphone according to claim 3, wherein the friction mechanism comprises a third cantilever comprised by the second headband part and a third friction element of elastomeric abutment material, which is attached to the third cantilever and due to elastic deformation of the third cantilever abuts and exerts a pressure against a third contact area of the first headband part.

5. A headphone according to claim 4, wherein the cantilevers are made of plastics and the elastomeric abutment material is rubber or silicone rubber.

6. A headphone according to claim 5, wherein the contact areas of the first headband part is made plastics, such as Polybutylene Terephthalate, Polycarbonate or Acrylonitrile Butadiene Styrene.

7. A headphone according to claim 5, wherein the cantilevers are 7-15 mm long, 2-8 mm wide and 0.2-1 mm thick.

8. A headphone according to claim 7, wherein the second headband part is slidable received in the first headband part.

9. A headphone according to claim 8, wherein the sliding movement between the first and second headband parts is guided by ribs and grooves.

10. A headphone 444 according to claim 9, wherein ribs are provided in inner side walls of the first headband part, and grooves are provided in outer sidewalls of the second headband part.

* * * * *